United States Patent [19]

Cocco et al.

[11] Patent Number: 5,005,284

[45] Date of Patent: Apr. 9, 1991

[54] METHOD OF ASSEMBLING TERMINALS WITH MODULAR PLUG

[75] Inventors: Eugene R. Cocco, Glendale; Bobby W. Rothman, Phoenix, both of Ariz.

[73] Assignee: AT&T Bell Laboratories, Murray Hill, N.J.

[21] Appl. No.: 533,975

[22] Filed: Jun. 6, 1990

Related U.S. Application Data

[62] Division of Ser. No. 273,301, Nov. 18, 1988, Pat. No. 4,950,176.

[51] Int. Cl.[5] ..... H01R 43/16

[52] U.S. Cl. ..... 29/884; 29/564.6; 29/566.1; 29/753; 29/876

[58] Field of Search ..... 29/884, 564.6, 566.1, 29/753, 876, 759

[56] References Cited

U.S. PATENT DOCUMENTS

| | | | |
|---|---|---|---|
| 3,699,498 | 10/1972 | Hardesty et al. . | |
| 3,835,445 | 9/1974 | Hardesty | 29/876 X |
| 3,839,787 | 10/1974 | Brown et al. . | |
| 3,860,316 | 1/1975 | Hardesty . | |
| 3,998,514 | 12/1976 | Hardesty . | |
| 4,002,392 | 1/1977 | Hardesty . | |
| 4,074,928 | 2/1978 | Johnston et al. . | |
| 4,090,763 | 5/1978 | Congdon et al. . | |
| 4,148,539 | 4/1979 | Hardesty . | |
| 4,178,675 | 12/1979 | Phillips | 29/566.1 |
| 4,239,316 | 12/1990 | Spalding . | |
| 4,258,469 | 3/1981 | Salvesen | 29/564.6 X |
| 4,516,822 | 5/1985 | Wolfel . | |
| 4,618,202 | 10/1986 | Libregts . | |
| 4,667,398 | 5/1987 | Leiby | 29/753 X |

*Primary Examiner*—Carl E. Hall
*Assistant Examiner*—Carl J. Arbes
*Attorney, Agent, or Firm*—E. W. Somers

[57] ABSTRACT

A plurality of the terminals (42—42) are mounted in slots which open to an inner surface (75) of a well (78) of a housing (41) of a modular plug (23) to terminate conductors (22—22) of an end of a cordage (21) that has been secured within the housing. The slots communicate with a cavity in which are disposed conductors of the cordage. Each terminal includes a body portion (84) having first and second ends (87 and 88). Internal contacting portions in the form of tangs (92—92) protrude from the body portion and engage electrically the conductors of the cordage. An external contact portion (94) of each terminal protrudes from and is disposed asymmetrically along the body portion between its ends. The external contact portion of each terminal is disposed between partitions (79—79) which extend from the inner surface of the well to an exterior surface of the housing or between such a partition and a sidewall of the housing. The external contact portion is adjacent to a termination end of the housing which first enters a cavity (37) of a jack into which the plug is inserted. When the plug is inserted into the jack cavity, wire-like contact elements (39—39) engage the external contact portions of the terminals to establish electrical connections between the plug and the jack. Because the partitions extend only from the termination end of the well toward the other end a distance that corresponds to the length of the external contact portions of the terminals, an insertion ram is able to contact simultaneously those surfaces of all the terminals which extend from the external contact portions to the other end of the well. The inner surface of the well acts as a positive stop for the insertion ram to cause the external contact portion of each terminal to be a required distance above the inner surface of the well.

4 Claims, 4 Drawing Sheets

METHOD OF ASSEMBLING TERMINALS WITH MODULAR PLUG

This is a division of application Ser. No. 07/273,301 filed 11/18/88, now U.S. Pat. No. 4,950,176 issued Aug. 21, 1990.

TECHNICAL FIELD

This invention relates to methods of assembly terminals to a modular plug which may be used to terminate cordage. More particularly, it relates to methods of terminating cordage with a modular plug which includes a housing having facilities that enhance the assembly therewith of a plurality of terminals.

BACKGROUND OF THE INVENTION

A conductor of a telephone cord which connects a telephone handset to a telephone base and a telephone base to a wall terminal generally comprises a polymeric core having a plurality of tinsel ribbons wrapped helically thereabout. The tinsel conductors are covered with a suitable insulative covering such as that, for example, which is disclosed and claimed in U.S. Pat. No. 4,090,763 issued on May 23, 1978 in the names of W. I. Congdon et al. A plurality of the individually insulated conductors are jacketed with a plasticized polyvinyl chloride (PVC) composition.

In a commonly used cord connection arrangement, each end of a line or handset cord is terminated with a miniature plug, which is termed modular, to facilitate attachment to jacks in telephone instruments and in wall outlets. An end of a cord is inserted into one end of a modular plug and secured therein. The modular plug is adapted to be inserted into a cavity of a jack to establish electrical connections between cord conductors which are terminated within the plug and contact elements in the form of wires in the jack. Modular plugs are disclosed, for example, in U.S. Pat. Nos. 3,699,498 and 4,148,539 which issued Oct. 17, 1972 and Apr. 10, 1979, respectively, in the names of E. C. Hardesty, C. L. Krumreich, A. E. Mulbarger, Jr., and S. W. Walden and in the name of E. C. Hardesty.

Typically, a modular plug includes a plastic housing having conductor-receiving troughs which communicate with a cord-receiving opening at one end of the plug. An opposite end of the plug is referred to as a termination or free end. Terminal-receiving slots extend between the troughs and an outwardly facing inner surface of a well of the housing from which a plurality of partitions extend to an outer surface of the housing. Each slot opens to the inner surface of the well between two partitions or between a partition and a sidewall of the housing.

In the termination of a cord with a plug, the jacket is removed from an end portion of a length of cordage. That end portion is inserted into the cord-receiving end of the plug with end portions of the conductors being received in the plug troughs. Then the end portion of the length of cordage is secured within the plug and the plug is positioned in a nest to receive a plurality of terminals. Plated strips of terminals are fed into insertion apparatus such as is shown in U.S. Pat. No. 3,839,787 which issued on Oct. 8, 1974 in the names of W. B. Brown and F. D. Gavin. Terminals are severed from the strips and seated within the terminal-receiving slots to engage electrically the cord conductors in the troughs. The slots are spaced to cause the seated terminals to engage the contact wires when the plug is inserted into a jack cavity and thereby connect electrically the cord conductors to the jack.

One prior terminal is described in abovementioned U.S. Pat. No. 4,148,539. It is made from sheet stock of an electrically conductive material such as, for example, a Phosphor-bronze alloy. The terminal has flat faces spaced apart by an edge surface which includes an internal contact portion comprising protruding tangs. When the terminals are seated fully within the plug housing, the tangs pierce the insulation of an engage electrically the conductors of the cord which has been inserted into the one end of the plug.

Each terminal also includes an external contact portion being exposed to an outer surface of the housing and having an outer surface which is spaced slightly from outer edge surfaces of the partitions which are coplanar with the outer surface of the housing. These portions of the terminals are adapted to complete electrical connections from the conductors of the cord to the jack. Each external contact portion includes an edge surface having a crown of a predetermined radius formed at each end thereof. The terminal is symmetrical with respect to an axis which extends through its center of gravity and which is normal to the edge surface of the external contact portion.

That crown which is adjacent to the termination end of the plug housing functions to engage an aligned wire-like contact element of the jack into which the plug is inserted. Inasmuch as the wire-like contact element of the jack extends angularly within the cavity of the jack into which the plug is inserted, the contact element engages only a portion of the aligned terminal, specifically a portion of the crown adjacent to the termination end of the plug.

Substantially the entire surface area of the hereinbefore-described terminal is covered with a layer or layers of metallic material by a process such as electroplating, for example. Only those edge surfaces of the terminals which are formed as each terminal is severed from its strip are unplated. Substantially the entire surface area is covered with nickel which provides corrosion resistance, smooths the terminal metal, and prevents diffusion of the terminal metal into a subsequently deposited layer of metallic material. The nickel is covered with a relatively thin layer of gold which is called a strike and which enhances the connection to the cord conductor.

Also, selected surface areas of the external contact portion have been covered with an additional layer of metallic material such as gold to enhance the conductivity of the connection with a contact wire of the jack. The selected portions include the crowns because they are exposed and because one of the crowns of each terminal is engaged by an aligned contact wire of a jack. The exposed edge surface between the crowns also is covered, as well as a relatively small portion of each flat side surface.

Significant cost savings have been realized by reducing the area of the selected surface portions which are covered, particularly in view of the large number of plugs which are manufactured each year. The foregoing problem has been overcome by a relatively new flat blade-like terminal in which the external contact portion of the blade has been reconfigured to resemble a fin, for example. Each terminal is made of an electrically conductive material and comprises a body portion which includes a reference surface that extends from a first end of the terminal toward a second end. The terminal includes an internal contact portion for piercing the insulation of and making an electrical connection with a cord conductor when the terminal is seated fully in the plug housing. Each terminal also includes a fin-like portion having a curved leading edge surface which is adjacent to the termination end of the plug housing and a linear trailing edge surface that is normal to the reference edge surface. Inasmuch as the curved edge surface only is engaged by the wire-like contact element of a jack when the plug is inserted into its cavity, only it and portions of adjoining side surfaces are plated with the gold. The external contact portion protrudes from the body portion and is disposed asymmetrically between the ends of the body portion adjacent to the first end of the terminal.

A terminal having the reconfigured external contact portion is inserted into each slot of the housing such that the first end and hence the external contact portion of each is oriented toward the termination end of the housing. The internal contact portion of the terminal establishes an electrical connection with a conductor of the cord that has been inserted into the housing prior to the insertion of the terminals. The external contact portion of each terminal extends beyond the slot in which the terminal is seated and is adapted to make electrical engagement with a wire-like contact element of a jack when the plug is inserted into the cavity of the jack.

In a method of assembling the terminals having the reconfigured external contact portions with a plug housing, rams which are used to insert the terminals in the housing do not engage the selected portions of the surface area which have been plated with the gold, but instead engage the reference surface between the trailing edge of the external contact portion and the trailing edge of the terminal. This avoids inadvertent removal of the selective plating. Also, the external contact portion which is positioned along the body portion is offset sufficiently from a centerline of the terminal to allow a ram to insert the terminal in the plug housing without canting it.

It is not uncommon that after a period of use, cords are refurbished by service organizations, which generally do not have the capital investment in equipment found in a manufacturing environment. When cords are refurbished, it is desired to reterminate one or both ends of the cords with modular plugs. Furthermore, it is not uncommon in today's world for a customer to terminate cordage with a modular plug.

Desirably, modular plugs which have been factory assembled to the point of having the terminals thereof partially inserted are available commercially. The service organizations and/or customers then need only insert the cord, actuate strain relief facilities such as are shown in U.S. Pat. No. 4,148,539 and seat completely the terminals.

Each terminal has barbs formed on opposed end surfaces thereof. The barbs and the lengths of the slots in the housing are such that they cooperate to support the terminals within the openings to space the external contact portions above the inner surface of the well with the barbs being embedded in end walls which define the slots to prevent unintended pivotal movement of the terminals while each of the terminals is in a partially inserted position. Upon the further application of insertion forces to the a terminals subsequent to insertion of conductors into the cavity, the terminals are caused to be moved further into the slots to embed another set of barbs in the material defining the slot and seat fully the terminals within the housing. The embedding of the barbs in the material defining the slots stabilizes the terminals and prevents unintended lateral and longitudinal as well as linear movements thereof.

In order to seat the terminals in the modular plug, a tool having a plurality of spaced blade-like rams is moved to engage exposed portions of the terminals. Each ram engages an exposed edge surface of terminal and as the tool is moved toward the plug, each ram is received between two partition walls or between a partition wall and a sidewall of the housing. Such tools are expensive because of the precision required to be able to move the blade-like ram portions between partition walls or partition walls and sidewalls of the housing. Also, the relatively thin rams may slip to one side of the terminals. Further, care must be taken to insure that the ram which follows the associated terminal inserts the terminal into its slot so that a predetermined portion of the terminal protrudes above the inner surface of the well toward the outer surface of the housing. This distance by which the terminal protrudes from its slot is an F.C.C. requirement. These problems are exacerbated when hand tools are used by customers to seat the terminals to terminate a cord.

What is needed and seemingly what is not shown in the prior art are methods of assembling terminals to a modular plug which includes a housing that facilitates the insertion of a plurality of terminals to a predetermined depth within the housing. It should be apparent that a modular plug which is a solution to this problem is one that has the same outer configuration as the presently manufactured plugs and which will be matable with presently used modular jacks.

SUMMARY OF THE INVENTION

The foregoing problems of the prior art have been overcome by methods of this invention for assembling a modular plug to cordage. A modular plug for making an electrical connection between conductors and components external to the plug comprises a dielectric housing which includes a conductor-receiving end and a termination end. The housing includes a cavity for holding end portions of conductors and a plurality of terminal-receiving slots each communicating with the cavity and opening to an inner surface of a well which opens to an exterior surface of the housing, and a plurality of electrically conductive flat blade-like terminals each of which is positioned in one of the slots. Each terminal comprises a body portion having a first end adjacent to the termination end and a second end oriented toward the conductor-receiving end of the housing. An internal contact portion of each terminal extends from the body portion into the cavity for making electrical engagement with an aligned conductor, and an external contact portion extends towards the exterior surface of the housing for engaging and establishing an electrical connection with an external component. The dielectric housing also includes a plurality of partitions with portions of the partitions extending from the inner surface of the well to the outer surface of the housing. The portions of the partitions extend for only a portion of the distance between opposite ends of the well with any remaining length of the partitions therebeyond extending a distance toward the exterior surface which does not exceed the distance by which a reference surface of each terminal extends from the slots toward the exterior surface of the housing when the terminals are seated fully in the housing.

In the methods of assembling electrically conductive flat blade-like terminals to a dielectric housing of a plug to terminate conductors of a cordage, each terminal having a body portion with an internal contact portion and an external contact portion extending from said body portion. The external contact portion is disposed asymmetrically between ends of the body portion. Included is the step of advancing a plurality of repetitively configured strips of material along a path to move a leading portion of each into a nest wherein the leading portion is supported along a leading edge and two adjoining faces thereof. The leading portion is separated from the successive repetitively configured portion of each strip to form a plurality of terminals having a trailing edge opposite the leading edge while covering the nest to complete the support of each terminal across its trailing edge. A dielectric housing is supported to align a plurality of terminal-receiving slots of the housing with the terminals, the housing including a plurality of partitions which extend from an inner surface of a well to which the slots open to an outer surface of the plug and which extend from a free end of the plug to ends of the external contact portions of the terminals. An edge surface of the body portion of each terminal between the external contact portion and the trailing edge is engaged with one of a plurality of insertion rams. The insertion rams are caused to move ther terminals partially into the housing between partitions and between partitions and sidewalls of the housing to cause side edge barbs of the terminal to become embedded in the plastic material of the housing. Subsequently, the reference edge surfaces of the terminals are reengaged with a common ram and the ram caused to seat fully the terminals within the housing to cause the internal contact portions to engage electrically the cordage conductors and to cause strain relief facilities of the plug to engage the conductors and a jacket of the cordage.

BRIEF DESCRIPTION OF THE DRAWING

Other objects and features of the present invention will be more readily understood from the following detailed description of specific embodiments thereof when read in conjunction with the accompanying drawings, in which.

DETAILED DESCRIPTION

Modular cord systems typically include cords 20—20 (see FIG. 1), each comprising a length of cordage 21 terminated at each end by a modular plug 23. The cordage 21 includes a plurality of individually insulated flexible conductors 22—22 (see FIG. 2). The cords are terminated with modular plugs 23—23 of the type shown, for example, in priorly mentioned U.S. Pat. No. 4,148,539 which is incorporated by reference hereinto.

The phrase "modular cord system" is intended to describe a system which includes the use of devices mounted in equipment and assembled to cord ends to permit customer connection of the cords to the equipment. Modular devices also reduce the amount of work required by installers. The economic advantages of modular systems together with the convenience afforded the customer have resulted in widespread acceptance of such a system.

The construction of the cordage 21 is well known. The flexible conductor 22 may be stranded wire or a filamentary core having a plurality of tinsel ribbons wrapped helically thereabout and enclosed with a suitable insulative covering such as that, for example, disclosed and claimed in hereinbefore identified U.S. Pat. No. 4,090,763. The insulated conductors 22—22 (see FIG. 2) may be disposed side-by-side in a planar array and are enclosed in a common jacket 34 made of a suitable plastic material. The final cord configuration has a cross-section with parallel sides and semi-circular ends and is referred to as a flat cord. Also, the insulated conductors may be disposed in a non-planar configuration such that the transverse cross section of the cordage is circular.

Figure 2:
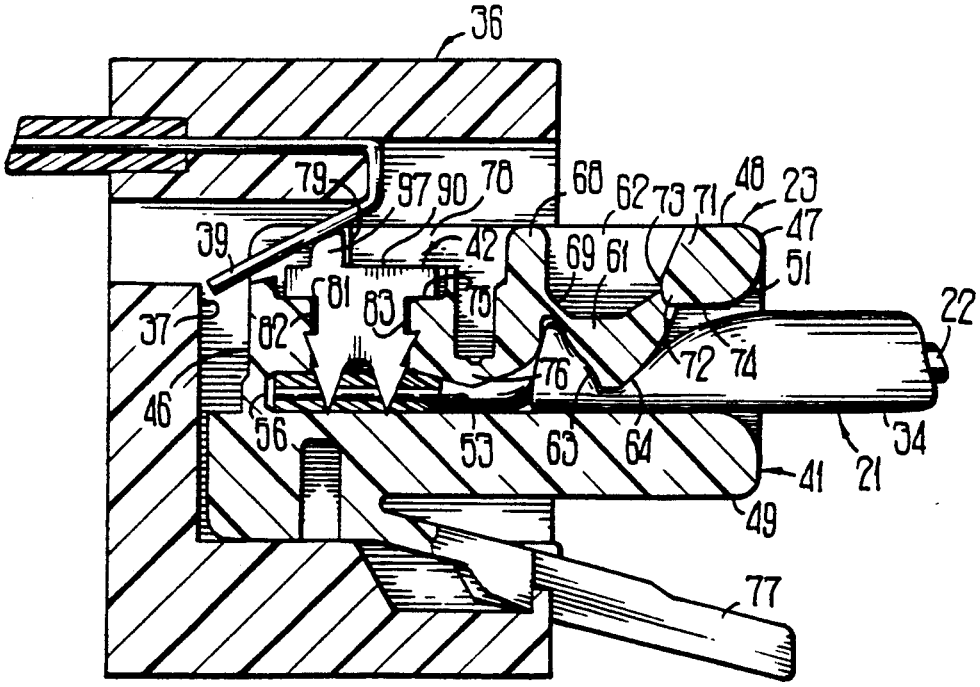
FIG. 2 is an elevational view in section of the modular plug which is shown in FIG. 1 as inserted into a cavity of a jack with terminals being seated fully in a housing of the plug.

The cord 20 is connected to a telephone hand set, to a telephone base, or to a wall terminal by inserting a plug 23 into a jack 36 (see FIG. 2). The jack 36 is typically that shown in U.S. Pat. No. 3,990,764 which issued Nov. 9, 1976 in the name of C. L. Krumreich and which is incorporated by reference hereinto. The jack 36 includes a cavity 37 and a plurality of wire-like contact elements 39—39 which are spaced on 0.10 cm centers and which protrude angularly into the cavity of the jack in which is received the modular plug.

Figure 1:
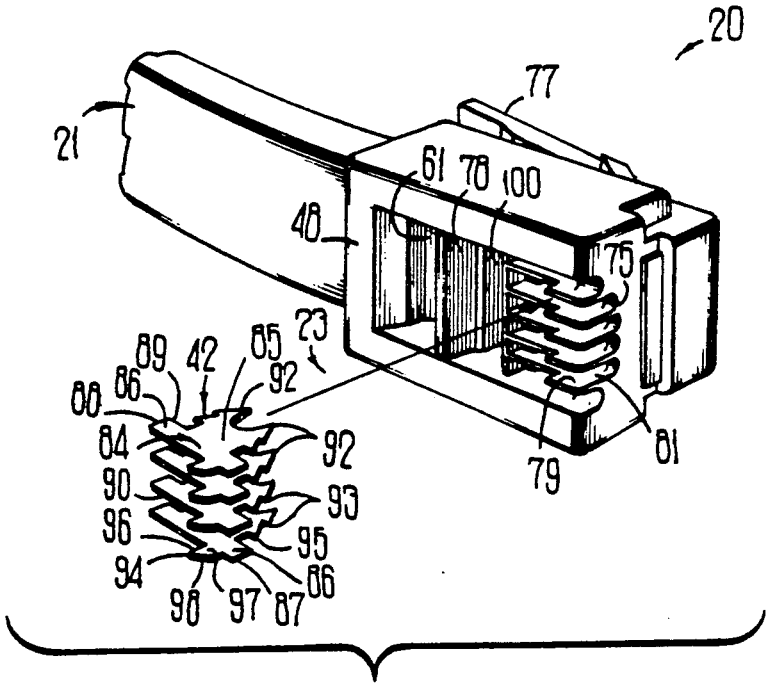
FIG. 1 is a perspective view of a portion of a telephone cord which comprises insulated tinsel conductors and which is terminated by a modular plug in accordance with methods of of this invention.

As can be seen in FIGS. 1 and 2, the modular plug 23 constructed in accordance with the principles of this invention includes a housing 41, which is made from a dielectric material, and a plurality of terminals 42—42. The terminals 42—42 are destined to connect electrically the conductors 22—22 of the cord which are housed within the plug 23 and electrical components of telephone apparatus such as, for example, the wire-like contact elements 39—39 of the jack 36. The terminals 42—42 are mounted within the housing 41 to be engagable by the contact wires 39—39 in the jack 36.

The plug housing 41 is a unipartite rigid housing (see FIGS. 1 and 2) made from a plastic material such as polycarbonate. The housing 41 includes a so-called free or termination end 46 which is closed. Further, the housing 41 includes a cord input end 47, a terminal-receiving side 48 and a side 49 opposite the terminal-receiving side. As may be observed from the drawings, the cord input end 47 of the housing 41 is formed with a flared cord input aperture 51 designed to circumscribe generally the outer periphery of the largest cord expected to be terminated with the plug 23. The aperture 51 opens to a cavity 53 which includes a plurality of conductor-receiving troughs 56—56.

The conductor-receiving troughs 56—56 are constructed to provide a plurality of individual duct-like compartments which are disposed in one tier for receiving the conductors of a cord 20. They extend longitudinally from the vicinity of the free end 46. Each of the compartments is of sufficient size to accept one of the conductors of the cordage 21.

An assembler removes a sufficient length of the cordage jacket 34 to permit insertion of the conductors into the troughs 56—56. Then the assembler installs the jacketed portion of the cordage 21 into the aperture 51 with the conductors extending farther along into the troughs 56—56.

The modular plug 23 also is provided with jacket strain relief facilities. A jacket anchoring member 61 is disposed within an opening 62 which opens to the terminal-receiving side of the housing and includes surfaces 63 and 64. The anchoring member 62 is connected to a portion 68 of the housing through a plastic hinge 69 which is oriented toward the free end 46 of the housing 41. At its other end, the anchoring member is connected temporarily by a fragile web (not shown) to a wall 71 adjacent the cord input end 47 of the housing. The web supports the anchoring member 62 in the as-manufactured, unoperated position to permit insertion of the end portion of the cordage 21 into the cavity 53. See U.S. Pat. No. 4,002,392 which issued on Jan. 11, 1977 in the name of E. C. Hardesty.

After having inserted an end portion of a cordage 21 into the cavity 53, the assembler applies forces to the anchoring member 61 to break the web and move the anchoring member about its plastic hinge 69. A stop 72 cooperates with the surfaces 73 and 74 to maintain the anchoring member in locked engagement with the cord and housing.

The plug 23 also may include a conductor strain relief portion 76. This is disclosed in U.S. Pat. Nos. 3,860,316 and 4,002,392, which are incorporated by reference hereinto. It is designed to anchor the conductors in engagement with the bottom of the chamber in order to provide strain relief for the conductors. Also, a depressible tab 77 is provided for locking the plug within a jack with the tab and its operation being disclosed in priorly identified U.S. Pat. No. 4,148,539.

Figure 3:
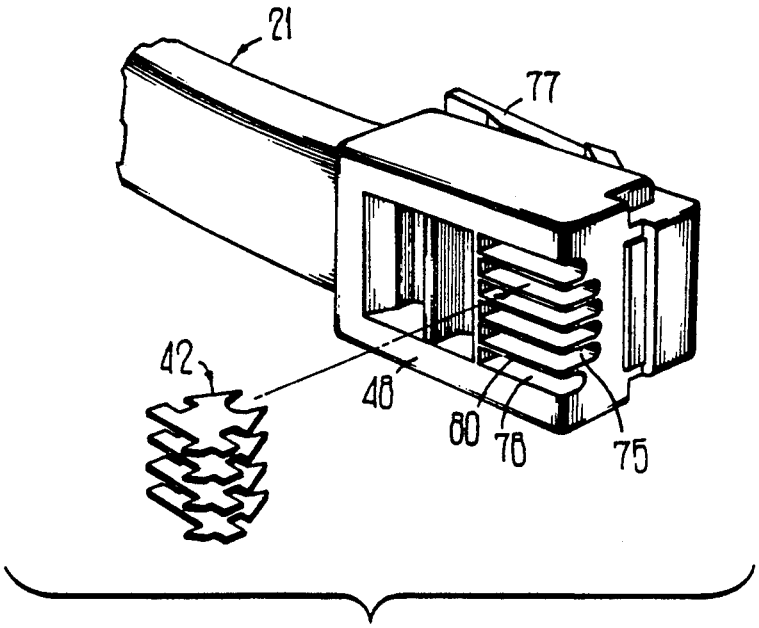
PRIOR ART FIG 3
FIG. 3 is a perspective view of a prior art modular plug.

In order to mount a plurality of the terminals 42—42 in the housing 41, the housing is constructed with a well 78 (see FIG. 1) opening to the terminal-receiving side 48 of the plug. Going now to FIG. 3, there is shown a prior art modular plug. In it, the well 78 has a plurality of spaced, longitudinally extending dielectric separators in the form of partitions 80—80 which project from an inner surface 75 of the well to the terminal-receiving side 48. The partitions 80—80 are spaced apart on 0.10 cm centers in order to correspond to the spacing of the wire-like contact members 39—39 of the jack 36. In the prior art plug, each partition 80 extends from one end of the well 78 to the other. The plug 20 of this invention includes a plurality of portions 79—79. In the plug 20, the portion of each partition 79 which extends to and which is coplanar with the terminal-receiving side 48 extends for only of the fraction of the distance between the ends of the well 78 (see FIGS. 1 and 2). When a plug 23 is inserted into a jack 36, each wire-like contact member 39 is received between adjacent ones of the partitions 79—79 adjacent to the free end of the plug or between a partition and a side-wall of the well 78.

Each terminal 42 is adapted to be received in a terminal-receiving slot 81 (see FIG. 2). Each of the terminal-receiving slots 81—81 opens to the surface 75 and connects the well 78 with an associated one of the conductor-receiving troughs 56—56. The terminal-receiving slots 81—81 extend parallel to the troughs 56—56 and include end walls 82 and 83. As can be seen on FIG. 1, the end walls 82 and 83 are oriented toward the free end 46 and the cord input end 47, respectively, of the housing 41.

Each of the terminals 42—42 is flat and blade-like and is made from a strip of an electrically conductive material such as, for example, brass or Phosphor-bronze alloy. As can best be seen in the drawings and particularly FIGS. 1 and 2 thereof, each terminal 42 includes a body portion 84 defined by flat faces 85—85 which are spaced apart by end edge surfaces 87 and 88. The end surfaces 87 and 88 are interrupted by cutouts 89—89 to form shoulders 86—86. The terminal has an overall height of about 0.42 cm, an overall length of about 0.34 cm which is designated L, and a thickness of about 0.03 cm.

Internal contact portions in the form of tangs 92—92 extend from a lower portion of the body 84 of the terminal 42. When the terminals 42—42 are seated fully within the housing 41, the tangs 92—92 pierce through the insulation of and engage electrically the conductors 22—22. When the terminal 42 is in the fully seated position, the tangs 92—92 extend through the conductors and become embedded slightly, e.g. 0.008 to 0.013 cm, in the bottoms of the conductor-receiving facilities of the housing. This supplements side edge support of the terminals 42—42 in the housing 41 to prevent unintended movement of the terminals.

The terminal 42 also includes two sets of side edge barbs. One set of barbs 93—93 are disposed adjacent to the tangs 92—92 and have outer points which are spaced 0.25 cm apart. Another set of side barbs 95—95 are disposed between the side barbs 92—92 and shoulder portions 86—86. The out-to-out distance of the side barbs 95—95 is about 0.27 cm. As the terminals 42—42 are seated in the housing 41, the barbs 93—93 and the barbs 95—95 dig into the end walls 82 and 83 of the housing 41 to anchor the terminals in the slots 81—81. The plastic housing 41 cooperates with the edge surfaces of the terminal 42 to support the terminals in an inserted position.

Each terminal 42 has an externally facing portion in the form of a reference edge surface 90 (see FIGS. 1-2 and 4-5). The reference edge surface 90 extends from the end edge surface 88 toward the other end edge surface 87. Because the reference edge surface 90 is spaced a predetermined distance from the tangs 92—92 which engage the plastic material of the housing 41, it becomes a datum or reference surface for internal and external contact portions of the terminal 42.

In order to engage an external component such as a jack wire, the terminal 42 includes an external contact portion. The external contact portion is exposed to an outer surface of the housing to engage an aligned external component such as a wire-like contact element 39 of a jack 36 into which the plug is inserted to complete an electrical circuit from the cord to the jack.

In a preferred embodiment, the external contact portion is configured to include a fin-shaped protrusion 94

(see FIGS. 1, 2, 4 and 5) which extends from the body portion 84 along the exposed reference edge surface 90 of the terminal. As can be seen particularly in FIG. 4, the protrusion 94 is disposed asymmetrically of the body portion 84 and is closer to the end surface 87 than to the end surface 88. When the terminal 42 is positioned in the housing 41, the protrusion 94 is adjacent to the termination end 46 of the housing 41.

The fin-shaped protrusion 94 includes a leading edge surface portion 98 having a radius and being curved convexly outwardly. The protrusion 94, which in the preferred amendment has the shape of a quarter-circle, also includes a trailing edge portion 96 which is normal to the reference edge surface 90 of the terminal.

The outermost portion of the protrusion 94 is spaced a predetermined distance above the reference surface 90. This insures that it is within a range of distance, i.e. about 0.046 to 0.071 cm below the outer edge surfaces of the partitions 79—79 when the tangs 92—92 are embedded in the bottoms of the troughs 56—56.

The protrusion 94 of the preferred embodiment is asymmetrical with respect to axes through its center of gravity which are parallel and normal to the edge surface 90. It should be realized that a terminal which includes an external contact portion that is symmetrical with respect to an axis which extends through its center of gravity and which is normal to the reference edge surface 90 is also within the scope of the invention.

The location of the fin-shaped portion 94 along the reference edge surface 90 of the terminal 42 is important to the connection between each jack contact wire 39 and its corresponding plug terminal. It has been found that in the preferred embodiment, the distance from the leading end surface 87 of the terminal 42 to the intersection of the fin-shaped protrusion 94 with an extension of the reference edge surface 90 is about 0.075 L. This establishes the distance from the termination end 46 of plug to the protrusion 94 and insures that each contact wire 39 engages the curved leading edge surface portion 98 of the aligned terminal 42. As can be seen in FIG. 2, the contact wire 39 is substantially tangent to the leading edge surface 98.

In order to smooth the surface area of the terminal metal and to provide protection against corrosion, substantially its entire surface area is covered with a 0.000254 cm layer of nickel. The nickel as well as additional metallic material is generally applied by a process of electroplating, for example. Only the side edge surfaces 87 and 88, which are formed as the terminals 42—42 are separated from a plated strip of terminals, are unplated. Further, the nickel is plated with a 0.000013 cm layer of gold which is called a strike. This relatively thin layer of gold provides low insertion resistance for the tangs 92—92 and maintains the surface area in a condition which causes subsequently deposited gold to adhere better to the terminal.

Selected surfaces of the terminals 42—42 are plated with additional metallic material such as gold, for example, to enhance the electrical connections between the contact wires of the jack and the terminals. The plating enhances the electrical conductivity of the connections and insures low contact resistance notwithstanding the low resistance forces experienced between the contact wires 39—39 of the jack 36 and the terminal 42—42.

By constructing the terminal 42 as shown in in FIG. 2 of the drawings, the selected surface area which is plated with additional metallic material is reduced significantly. As will be recalled, the prior art terminal had an upper edge surface which extended to the top of the present fin portion 94. As should be evident from FIG. 4 which shows the insertion of the modular plug 23 into the jack 36, only the leading edge surface portion, that is the curved portion 98 of the fin-shaped projection 94, is engaged by the contact element 39 of the jack 36. Therefore, the terminal 42 need only be plated selectively with additional gold.

Accordingly, only the curved portion 98 of the protrusion 94 and portions of its flat side surfaces 97—97 are plated with additional gold. For retractile cords, the additional plating has a thickness of about 0.00013 cm while for a line cord it is about 0.00032 cm. This effectively reduces the selectively plated area of the terminal 42 and results in significant cost savings.

Returning now to FIGS. 1-2 and 4, it can be seen that the modular plug of the invention include facilities which enhance the assembly of the terminals 42—42 with the plug housing 41. Partitions 79—79 within the well 78 are arranged to provide a recess 100 which allows the terminals 42—42 to be gang-inserted by a single flat ram and which provides positive depth of insertion as a result of the inner surface 75 of the well acting as a positive stop for the single flat ram.

For example, as shown in FIG. 2, partitions 79—79 extend only from the free end 46 of the housing for a limited distance toward the opposite end of the well 78. The partitions 79—79 extend about to the trailing end surface 96 of the fin-like protrusion 94 of each terminal. As a result, the portion of the well 78 between the trailing end surfaces 96—96 of the terminals 42—42 and the end of the well which is adjacent to the strain relief facilities is unobstructed.

Figure 6:
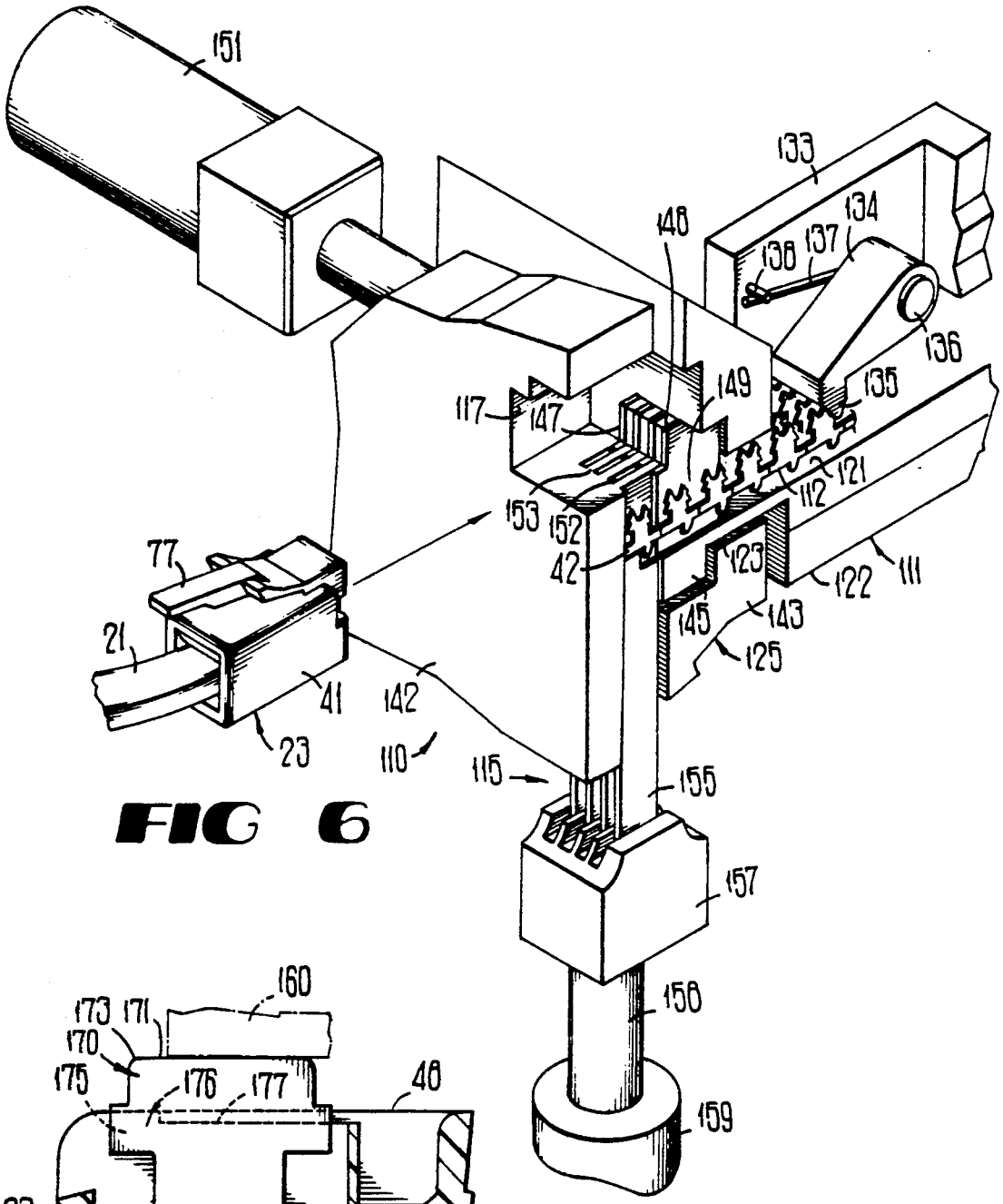
FIG. 6 is a perspective view of an apparatus for inserting partially terminals of this invention into a modular plug housing.

This arrangement is most advantageous during the assembly of the terminals to the plug housing 41. In order to point out those advantages, it becomes important to describe apparatus which has been used to insert terminals into the prior art plug having partitions which extended the full length of the well 78 and apparatus which is used to insert terminals into the plug housing of this invention. Apparatus 110 for assembling terminals is shown in FIG. 6. The apparatus which is used for inserting the terminals into a prior art plug housing is disclosed and claimed in previously mentioned U.S. Pat. No. 3,839,787 which is incorporated by reference hereinto.

Feeding facilities designated generally by the numeral 111 are provided for advancing a plurality of strips 112—112 of partially formed terminals into engagement with terminal forming and insertion apparatus, which is designated generally by the numeral 115. The terminal forming and insertion apparatus 115 includes facilities for receiving a leading portion of each of the repetitively configured strips 112—112 of partially formed terminals and for severing the leading portions therefrom. The plug end of the cord 20 is positioned in a nest 117. Then, each of the newly formed terminals 42—42 is engaged by a portion of the insertion apparatus 115 for movement into engagement with an associated one of the grooves in the housing 41 of the plug 23 which has been prepositioned in the nest 117 of the insertion facilities.

Each one of the plurality of strips 112—112 of partially formed terminals is advanced along an associated channel 121 in a trackway 122. At the initiation of each cycle of operation, each one of the channels 121 is aligned with an associated one of the slots of a plug housing 41 into which the terminals 42—42 are to be inserted. One end of the trackway 122 is received in an opening 123 of a reciprocally movable shearing assembly 125. The pivotable mounting of the trackway 122 permits the shearing assembly 125 to move reciprocally without bending the trackway. In this way, the miniature, fragile strips 112—112 of partially formed terminals may be constantly provided with support within the channels 121—121 without becoming bound therein because of deformed paths.

A bracket 133 is mounted slidably about the trackway between an air cylinder (not shown) and the shearing assembly 125. A pawl 134 having a toothed end 135 is mounted pivotally on a shaft 136 extending from the bracket. The pawl 134 is biased in a counter-clockwise direction by a wire-spring 137 wrapped about the shaft and extending into engagement with a pin 138 attached to the bracket. The pawl is positioned with respect to the trackway 121 so that the pawl spans transversely across the four strips 112—112 of partially formed terminals. Moreover, the toothed end of the pawl is designated to seat between adjacent ones of the tangs of the partially formed terminals.

Facilities for forming the terminals include the shearing assembly 125 which is supported in such a way that it may be moved in a direction transverse of a die block 142 and of the strips 112—112 to sever the leading portions therefrom. The shearing assembly 125 has an insert 143 received in an opening therein. The insert 143 is held within the opening and is formed to provide a plurality of openings each of which is designed to receive an associated one of the strips 112—112 of the partially formed terminals.

The insert 143 is also formed with an opening having a plurality of spaced fins 147—147 extending into the opening from a top surface. The fins 147—147 each have a width substantially equal to the thickness of one of the strips 112—112 of the partially formed terminals.

A shearing blade 148 is positioned in the opening of the shearing assembly 125 between each of the fins and between end ones of the fins and the walls of the opening. The blades 148—148 are used to separate leading portions of the strips 112—112 to form successive groups of the terminals.

The blades 148—148 are maintained spaced apart along the bottom portion thereof by spacer plates 145—145 interposed therebetween. Each spacer plate 145 has a thickness substantially equal to the thickness of the associated aligned fin 147. The top surface of each spacer plate is substantially coplanar with the bottom surface of each of the channels 121—121 of the trackway 122. In this way the blades 148—148, the spacer plates 145—145 and the bottom surfaces of the fins 147—147 cooperate and provide a plurality of spaced passageways 149—149 through which leading portions of the strips 112—112 are advanced.

Grooves 152—152 associated with the plug receiving nest 117 are formed by spacing inserts 153—153 in an opening in the die block 142. The passageways 149—149 in the shearing assembly 125 are aligned with the grooves 152—152 of the die block and are also aligned with the channels 121—121 in the trackway 122.

The insert 143 and the opening in the shearing assembly 143 are contoured to cooperate to receive the dielectric housing 41 of the plug 23. The opening in the shearing assembly 125 along one surface of the insert is stepped to form a recess.

The shearing assembly 125 is mounted slideably to be moved reciprocally by an air cylinder 151. With the leading portion of the strips 112—112 extended through the openings in the insert 143, the air cylinder 151 may be operated to move the shearing assembly 125 laterally of the strips. This motion causes the blades 148—148 to shear the leading portions of the repetitively configured strips to form the terminals 42—42.

The actuation of the air cylinder 151 which moves the shearing assembly 125 with respect to the die block 142 accomplishes a dual function. The blades 148—148 sever the portions interconnecting repetitive configured strips 112—112 to form terminals 42—42. Secondly, the movement is sufficient to cover the grooves 152—152 formed in the die block 142 and provide support for the newly formed trailing edges such that each newly formed terminal in each of the grooves is completely enclosed about its periphery.

The newly formed terminals 42—42 are aligned with associated ones of the terminal-receiving slots 81—81 in the plug housing 41 in the cavity 117. Also, in the assembly of terminals with the prior art modular plug, the edge surface 90 of each of the terminals 42—42 is aligned with a blade-like insertion ram 155 which is mounted slideably in the associated groove of the die block 142. Each of the insertion rams is attached to a head 157 which is connected to a piston rod 158 of an air cylinder 159 that is used to move reciprocally the insertion rams along the grooves.

Because of their relatively small thickness, the rams 155—155 tend to slip from engagement with the terminals. Also, in the event the apparatus 110 is used to seat fully the terminals 42—42 as has been done in the prior art plug of FIG. 3, constant care must be exercised to insure that each ram 155 drives its associated terminal into the plug so that the exposed edge surface of the terminal is a required distance above the inner surface 75 of the well.

Further, in assembling terminals with prior art plugs, it has been common to perform the insertion at one station of a turntable with other stations being devoted to actuation of strain relief facilities as well as other steps in the assembly process. Should problems with the invention station arise, the entire turntable needed to be shut down while the problem was corrected.

These problems are avoided with the modular plug of this invention. In a method of assembly of the terminals and housing of the plug of this invention, the apparatus 110 including the insertion rams 155—155 is used only to seat partially terminals in the plug housing. The final seating of the terminals is accomplished by a tool 160 which spans across the plurality of terminals (see FIGS. 4–5 and 7). As a result, the tooling used for the insertion of the terminals into the slots of the plug housing is much less fragile and longer lasting. Further, in the turntable assembly of the terminals with the plug housing, two stations become unnecessary.

In the operation of the apparatus, a plug housing 41 is inserted into the cavity 117. Then the operator controls the apparatus to advance the strips 112—112 to the left as viewed in FIG. 6. At that time, the leading edges of the strips 112—112 are in engagement with the face of the die block 142. As this occurs, contact tangs 92—92 of adjacent partially formed terminals of each strip 112 are under the toothed end of the pawl 134.

When the leading edges of the leading repetitively configured portions of the terminal strips engage the face of the die block 142, the two adjoining side faces of each of the leading portions are supported laterally by the walls of the grooves 152—152.

Then the operator controls the operation of the shearing assembly 125 to sever the interconnecting portions between the strips 112—112 of the terminals and to complete the formation of the terminals 42—42 in the die block 142. This results in the formation of a set of four terminals which are to be inserted in the plug housing 41 in the nest 117.

Next, the operator causes the apparatus 100 to function to insert the terminals partially into the dielectric plug housing 41. The air cylinder 159 is operated first to move the head 157 and insertion rams 155—155 upwardly with the newly formed terminals 42—42. The rams 155—155 move each terminal 42 along its groove 152 and partially into the aligned terminal-receiving slot 81 of the plug housing 41 (see FIG. 4). As the terminals 42—42 are moved into the slots 81—81, the barbs 93—93 along the sides of the terminals embed themselves along the walls of the plug housing to hold the terminals in their partially inserted positions. Then the cylinder 159 is cycled to withdraw the ram downwardly prior to the intermittent advance of the terminal strips 112—112 for the next cycle of terminal forming and insertion.

The foregoing operation is carried out at a separate station. Then the plugs with the terminals partially inserted thereinto are moved to a turntable where ends of cordage are inserted. A single ram 160 (see FIGS. 4-5 and 7) which also includes portions for actuating the conductor and cord jacket strain relief facilities is moved to engage the terminals and the strain relief portions.

Then the terminals are engaged with the common ram 160 which causes forces to be applied to the terminals to move them farther into the plug body. As the terminals are moved farther inwardly, the side barbs 95—95 becomes embedded in the plastic of the plug body (see FIGS. 2 and 7). Because the out-to-out distance of each of the barbs 95—95 is greater than that of the barbs 93—93, the barbs 95—95 anchor the terminals in their final position in which the tangs thereof engage electrically the cord conductors and thereby prevent inadvertent movement of the terminals. The ram 160 bottoms out in engagement with the inner surface 75 of the well 78. As a result, the edge surfaces 90—90 of the terminals 42—42 are coplanar with the surface 75. However, the protrusions 94—94 extend above the surface 75 toward the exterior surface 48 of the plug housing 41.

Advantageously, a guide surface for the insertion ram 160 is provided by the adjoining trailing edge surface 96 of the protrusion of the terminal. Also, the protrusion 94 is sufficiently off-center of the body portion 84 of the terminal to preclude canting of the terminal as it is moved along the groove 152 by the insertion ram 160. These features provide for trouble-free insertion of the terminals 42—42 into the plug housings 41—41.

Figure 7:
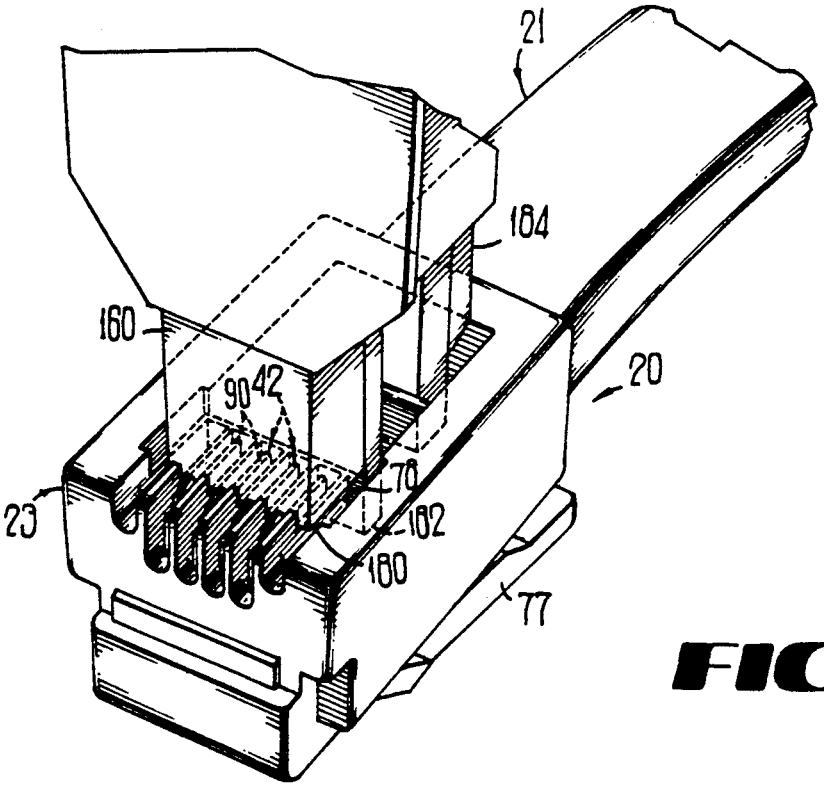
FIG. 7 is a perspective view of a common ram which is used to engage portions of a plurality of terminals.

Further, the recess 100 allows the inner surface of the well 78 to act as a stop for the ram 160 (see FIG. 7). As a result, the insertion depth of the terminals is controlled automatically.

Figure 4:
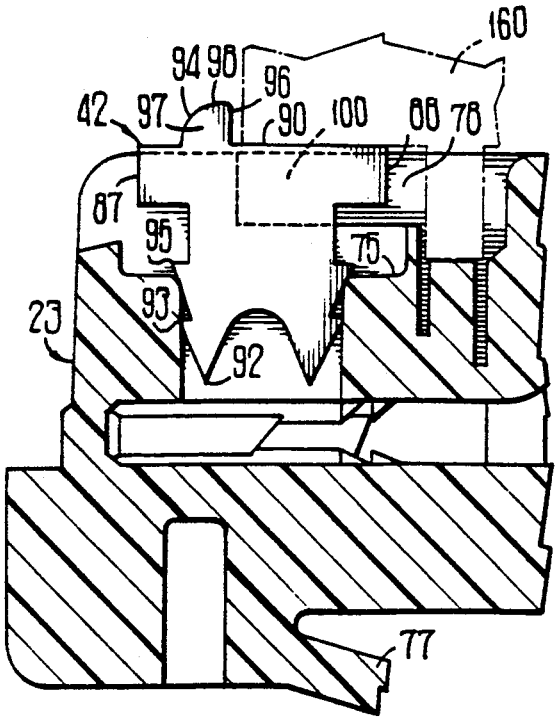
FIG. 4 is an enlarged elevational view of a terminal which is inserted partially into a housing of the plug of FIG. 1 in order to terminate conductors of a cord which are inserted into the plug.
Figure 5:
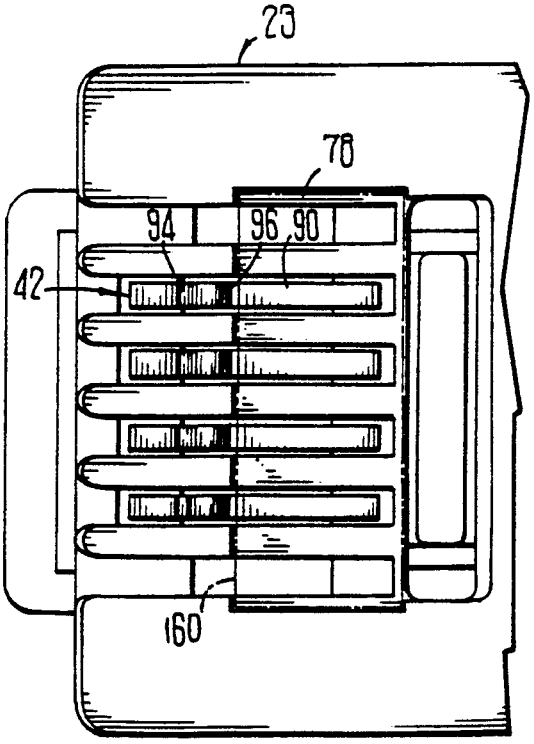
FIG. 5 is a plan view of the terminal of FIG. 4.

As can be seen from FIGS. 4-5, the single insertion ram 160 engages the edge surface 90 of each of the terminals 42—42 and is adjacent to the edge surface 96 of the fin-like protrusion 94 of the terminal. It should be appreciated that the ram 160 does not contact any of the selectively plated surfaces of the terminal 42. This avoids any inadvertent scuffing or removal of the plating material on the selected areas of the external contact portion.

In today's communications environment, the plug 41 of this invention has another important advantage. It becomes important for a household customer to be able to terminate a length of cordage with a modular plug. For such usage, it is customary to insert partially each terminal into its associated slot and to support the terminal in the slot in what is called an armed position with the tangs of each terminal above the conductor-receiving troughs to allow cord conductors to be inserted into the troughs. This has been somewhat difficult in the past because of the need to provide a relatively expensive hand tool (not shown) having a plurality of insertion rams 155—155 each associated with a terminal to move between plug housing partitions and insert the terminal blades into the slots and seat the terminals to a definite depth which is controlled when the ram contacts the bottom of the well 78 as a position stop. The procedure and the tool for inserting the terminals has become greatly simplified with the plug of this invention. Now the hand tool includes one insertion ram, similar to the ram 160 which spans across all the terminals and which moves the terminals together into the plug housing slots and seats the terminals to a predetermined depth which is controlled when the rams engage the bottom of the well 78 as a positive stop.

It should also be pointed out that a modular plug of this invention may include terminals 170—170 of the configuration which is shown in priorly mentioned U.S. Pat. No. 4,148,539 and in FIG. 8 hereof. In that configuration, an external contact portion 171 of the terminal extends for the length of the terminal. When such terminals are seated fully in the plug housing, a portion of each terminal projects above the surface 75 of the well 78 toward the exterior surface 48 of the plug. At the free end of the plug, contact wires of a jack, in which the plug is adapted to be received, will engage end portions 173—173 of the terminals which are oriented toward the free end of the plug. In order to prevent those wire-like portions of the jack from becoming dislodged from the edge surfaces of the terminals, portions 175—175 of partitions 176—176 are required to be disposed between those end portions of the terminals. Further in order to be effective in this function, the partition portions 175—175 should extend beyond the outer edge surfaces of the terminals to the outer surface 48 of the plug housing 41. However, beyond these end portions of the terminals, partition portions 177—177 need not extend beyond the outer edge surfaces of the terminals.

Figure 8:
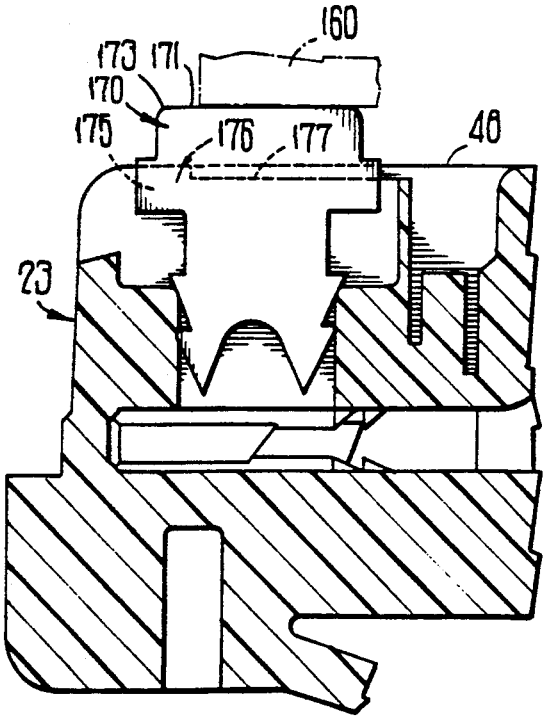
FIG. 8 is an elevational view of an alternate embodiment of the plug of this invention with a terminal thereof in a partially seated position.

Accordingly, in plugs which include the terminals 170—170, partitions between the terminals may be stepped (see FIG. 8). Portions 175—175 of the partitions 176—176 adjacent to the free end of the plug extend to the exterior surface 48 of the plug whereas the portions 177—177 oriented toward the strain relief facilities are recessed within the well 78. As a result, a common ram 160, as opposed to individual rams may be used to engage simultaneously and insert all the terminals in a plug. Such a ram is designed to engage only those portions of the terminals which extend from the stepped portions 175—175 of the partitions to the end of the well which is adjacent to the strain relief facilities of the plug.

Figure 9:
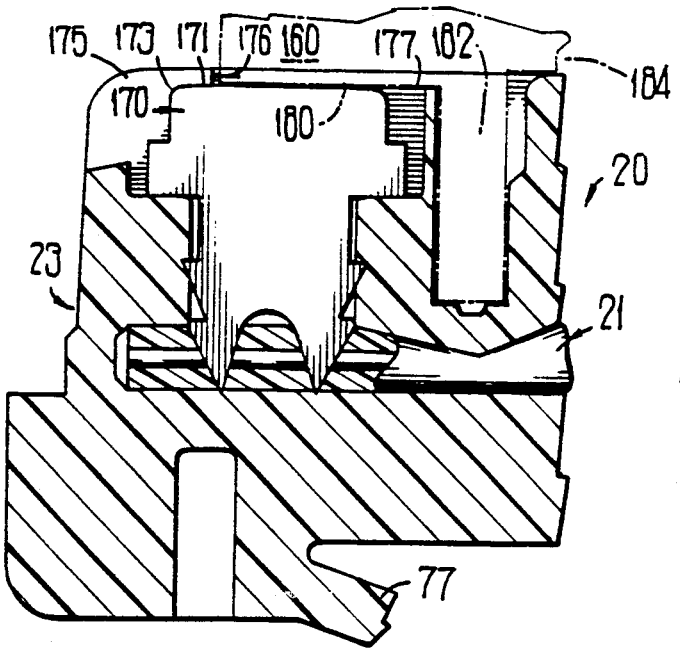
FIG. 9 is a view of the plug of FIG. 8 showing the terminal in a fully seated position.

Advantageously, here as in the case of the fin-shaped blade, a positive stop is provided for the seating ram. In this instance, the tops of the stepped-down portions 177—177 of the partitions 176—176 act as a stop for the ram as it inserts the terminals into the plug and seats them fully (see FIG. 9).

Here as in the plug with the fin-shaped type blade, manufacturing economies are realized. In each instance, a cordage 21 to be terminated is caused to be disposed in a U-shaped configuration on a rotating turntable. At one station in the assembly of the prior art plug of FIG. 3, each end of the cordage was caused to be inserted in a cavity of a modular plug. At a next station, the conductor and jacket strain relief facilities were actuated to secure the plug to the cord. Then at a next station terminals were inserted into one plug, and, at another station, into the other plug. With plugs of this invention, two stations may be eliminated. The common ram 160 may be structured to include not only a surface 180 (see FIG. 9) to engage the terminals, but also portions 182 and 184 to actuate the conductor anchoring bar and the jacket anchoring member of the plug.

It is to be understood that the above-described arrangements are simply illustrative of the invention. Other arrangements may be devised by those skilled in the art which will embody the principles of the invention and fall within the spirit and scope thereof.

We claim:

1. A method of assembling electrically conductive flat blade-like terminals to a dielectric housing of a plug to terminate conductors of a cordage, each terminal having a body portion with an internal contact portion and an external contact portion extending from said body portion, the external contact portion being disposed asymmetrically between ends of said body portion, said method including the steps of:

advancing a plurality of repetitively configured strips of material along a path to move a leading portion of each into a nest wherein the leading portion is supported along a leading edge and two adjoining faces thereof;

separating the leading portion from the next successive repetitively configured portion of each strip to form a plurality of terminals each having a trailing edge opposite the leading edge while covering the nest to complete the support of each terminal across its trailing edge;

supporting a dielectric housing to align a plurality of terminal-receiving slots of the housing with the terminals, the housing including a plurality of partitions which extend from an inner surface of a well to which the slots open to an outer surface of the plug and which extend from a free end of the plug to ends of the external contact portions of the terminals;

engaging a reference edge surface of the body portion of each terminal between the external contact portion and the trailing edge with one of a plurality of insertion rams;

causing the insertion rams to move the terminals partially into the housing between partitions and between partitions and sidewalls of the housing to cause side edge barbs of each terminal to become embedded in the plastic material of the housing; and subsequently reengaging the reference edge surfaces of the terminals with a common ram and causing the ram to seat fully the terminals within the housing to cause the internal contact portions to engage electrically the cordage conductors and to cause strain relief facilities of the plug to engage the conductors and a jacket of the cordage.

2. The method of claim 1, wherein the movement of the common ram which is used to seat fully the terminals is discontinued when the common ram engages the inner surface of said well.

3. The method of claim 1, wherein the movement of the common ram which is used to seat fully the terminals is discontinued when the common ram engages outer edge surfaces of said partitions.

4. The method of claim 1, wherein the step of engaging the edge surface of the body portion is accomplished such that the forces applied thereto are balanced between leading and trailing edges of the terminal to avoid inadvertent canting of the terminals as they are inserted into the housing.

* * * * *